US011521576B2

(12) United States Patent
Matsumoto et al.

(10) Patent No.: US 11,521,576 B2
(45) Date of Patent: Dec. 6, 2022

(54) DISPLAY DEVICE AND METHOD OF PREVENTING AFTERIMAGE THEREOF

(71) Applicant: SAMSUNG DISPLAY CO., LTD., Yongin-si (KR)

(72) Inventors: Kazuhiro Matsumoto, Yokohama (JP); Yasuhiko Shinkaji, Yokohama (JP); Masahiko Takiguchi, Yokohama (JP)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/095,819

(22) Filed: Nov. 12, 2020

(65) Prior Publication Data

US 2021/0225326 A1 Jul. 22, 2021

(30) Foreign Application Priority Data

Jan. 21, 2020 (KR) ..... 10-2020-0007944

(51) Int. Cl.
*G09G 5/10* (2006.01)
*G09G 3/3208* (2016.01)
*G09G 3/20* (2006.01)

(52) U.S. Cl.
CPC ..... *G09G 5/10* (2013.01); *G09G 3/2003* (2013.01); *G09G 3/3208* (2013.01); *G09G 2320/0257* (2013.01); *G09G 2320/0646* (2013.01)

(58) Field of Classification Search
None
See application file for complete search history.

(56) References Cited

U.S. PATENT DOCUMENTS

2011/0090262 A1* 4/2011 Kim ..... G09G 3/3406 345/690
2014/0118423 A1* 5/2014 Hasegawa ..... G09G 3/3607 345/690
2014/0146071 A1* 5/2014 Kim ..... G09G 3/3225 345/589
2015/0154939 A1* 6/2015 Zhan ..... G06T 7/00 345/589
2018/0061344 A1* 3/2018 Kurokawa ..... G09G 3/3648
2019/0057652 A1* 2/2019 Lee ..... H04N 21/4316
2019/0180143 A1* 6/2019 Lyu ..... G06T 1/20
2019/0325616 A1* 10/2019 Chhaya ..... G06N 3/08
2020/0020303 A1* 1/2020 Kim ..... G09G 5/10
2020/0051017 A1* 2/2020 Dujmic ..... G06K 9/6271
2020/0170564 A1* 6/2020 Jiang ..... A61B 5/7267

FOREIGN PATENT DOCUMENTS

KR 10-2016-0019341 2/2016
KR 10-1782366 9/2017
KR 10-2021-0094691 7/2021

* cited by examiner

*Primary Examiner* — Benjamin C Lee
*Assistant Examiner* — Emily J Frank
(74) *Attorney, Agent, or Firm* — F. Chau & Associates, LLC

(57) ABSTRACT

The present disclosure provides a display device that includes a preprocessor, a controller, and a display panel. The preprocessor includes an area determiner outputting area data, a modulator outputting modulated data, and a synthesizer converting first image data and outputting second image data including the area data and the modulated data.

16 Claims, 11 Drawing Sheets

DISPLAY DEVICE AND METHOD OF PREVENTING AFTERIMAGE THEREOF

CROSS-REFERENCE TO RELATED APPLICATION

This U.S. non-provisional patent application claims priority under 35 U.S.C. § 119 of Korean Patent Application No. 10-2020-0007944, filed on Jan. 21, 2020, the contents of which are hereby incorporated by reference in their entirety.

BACKGROUND

1. Field of Disclosure

The present disclosure relates to a method of preventing an afterimage and a display device with improved display characteristics and reliability.

2. Description of the Related Art

Display devices show images to a user using light sources such as light-emitting diodes. Display devices are present in televisions, smartphones, and computers. An organic light-emitting display (OLED) device is a type of display device. OLED devices have fast response, low power consumption, superior light emission efficiency, good brightness, and a wide viewing angle.

Transistors or light-emitting diodes of a pixel may deteriorate when an OLED device is used for a long period of time. Furthermore, a difference in degree of deterioration between a certain display area and another display area adjacent to the certain display area occurs when the same image is continuously displayed in the certain display area.

The difference in degree of deterioration leads to the deterioration of display quality such as afterimages, or burn-in, on the display device. Therefore, there is a need in the art to increase the reliability of OLED devices, and to reduce the likelihood of afterimages.

SUMMARY

The present disclosure provides a display device with improved display characteristics and reliability. The present disclosure also provides a method of preventing an afterimage.

Embodiments of the inventive concept provide a display device including a preprocessor receiving first image data and converting the first image data to output second image data, a controller receiving the second image data and converting the second image data to output first converted image data obtained by converting a first image recognized as a non-afterimage component and second converted image data obtained by converting a second image recognized as an afterimage component, and a display panel displaying an image corresponding to the first converted image data and the second converted image data.

The preprocessor includes an area determiner outputting area data using area information including a first area and a second area adjacent to the first area to decrease a detection sensitivity of the first area and to increase a detection sensitivity of the second area, a modulator converting RGB data (i.e., color data) of the first image data to hue, saturation and value (HSV) data and modulating brightness data and saturation data of the HSV data to output modulated data, and a synthesizer converting the first image data to output the second image data including the area data and the modulated data.

The first area is a center area of the image, and the second area is a border area of the image, which surrounds the center area.

A probability that the non-afterimage component exists in the first area is greater than a probability that the afterimage component exists in the first area, and a probability that the afterimage component exists in the second area is greater than a probability that the non-afterimage component exists in the second area.

The modulated data include modulated brightness data obtained by inputting the brightness data to a first function and modulated saturation data obtained by inputting the saturation data to a second function.

The brightness data include a first brightness input value and a second brightness input value greater than the first brightness input value, the modulated brightness data include a first brightness output value obtained by inputting the first brightness input value to the first function and a second brightness output value obtained by inputting the second brightness input value to the first function, the first brightness output value is greater than the first brightness input value, and the second brightness output value is smaller than the second brightness input value.

The saturation data include a first saturation input value and a second saturation input value greater than the first saturation input value, the modulated saturation data include a first saturation output value obtained by inputting the first saturation input value to the second function and a second saturation output value obtained by inputting the second saturation input value to the second function, the first saturation output value is greater than the first saturation input value, and the second saturation output value is smaller than the second saturation input value.

At least one of the first function and the second function includes the following equation.

$$f_1(x) = \begin{cases} a_1 x, & x < th_{x1} \\ 1 - a_2(1-x), & x \geq th_{x2} \\ th_{y1} + a_3(x - th_{x1}), & \text{otherwise} \end{cases} \quad \text{Equation 1}$$

In Equation 1, "x" denotes the brightness data or the saturation data, "$f_1(x)$" denotes the modulated brightness data or the modulated saturation data, "$th_{x1}$" denotes the first brightness input value or the first saturation input value, "$th_{y1}$" denotes the first brightness output value or the first saturation output value, "$th_{x2}$" denotes the second brightness input value or the second saturation input value, "$th_{y2}$" denotes the second brightness output value or the second saturation output value, "$a_1$" denotes "$th_{y1}/th_{x1}$", "$a_2$" denotes "$(1-th_{y2})/(1-th_{x2})$", and "$a_3$" denotes "$(th_{y2}-th_{y1})/(th_{x2}-th_{x1})$".

At least one of the first function and the second function includes the following equation.

$$f_2(x) = \begin{cases} th_{y1}(r_1 x)^2, & x < th_{x1} \\ 1 - (1 - th_{y2})(r_2(1-x))^2, & x \geq th_{x2} \\ th_{y1} + a_3(x - th_{x1}), & \text{otherwise} \end{cases} \quad \text{Equation 2}$$

In Equation 2, "x" denotes the brightness data or the saturation data, "$f_2(x)$" denotes the modulated brightness data or the modulated saturation data, "$th_{x1}$" denotes the first brightness input value or the first saturation input value, "$th_{y1}$" denotes the first brightness output value or the first saturation output value, "$th_{x2}$" denotes the second brightness input value or the second saturation input value, "$th_{y2}$" denotes the second brightness output value or the second saturation output value, "$r_1$" denotes "$1/th_{x1}$", "$r_2$" denotes "$1/(1-th_{x1})$", and "$a_3$" denotes "$(th_{y2}-th_{y1})/(th_{x2}-th_{x1})$".

At least one of the first function and the second function includes the following equation.

$$f_3(x)\begin{cases} th_{y1}(2r_1x-(r_1x)^2), & x<th_{x1} \\ 1-(1-th_{y2})(2r_2(1-x)-(r_2(1-x))^2), & x\geq th_{x2} \\ th_{y1}+a_3(x-th_{x1}), & \text{otherwise} \end{cases} \quad \text{Equation 3}$$

In Equation 3, "x" denotes the brightness data or the saturation data, "$f_3(x)$" denotes the modulated brightness data or the modulated saturation data, "$th_{x1}$" denotes the first brightness input value or the first saturation input value, "$th_{y1}$" denotes the first brightness output value or the first saturation output value, "$th_{x2}$" denotes the second brightness input value or the second saturation input value, "$th_{y2}$" denotes the second brightness output value or the second saturation output value, "$r_1$" denotes "$1/th_{x1}$", "$r_2$" denotes "$1/(1-th_{x1})$", and "$a_3$" denotes "$(th_{y2}-th_{y1})/(th_{x2}-th_{x1})$".

The preprocessor further includes a pattern unit that provides a pattern to an area of an image corresponding to the modulated brightness data between the first brightness output value and the second brightness output value and an area of an image corresponding to the modulated saturation data between the first saturation output value and the second saturation output value.

The pattern has a shape extending in a first direction and spaced apart from each other in a second direction crossing the first direction. In some cases, the pattern has a shape extending in a first direction, spaced apart from each other in a second direction crossing the first direction, extending in the second direction, and spaced apart from each other in the first direction. In some cases, the second image data further include the pattern.

The controller includes a detector separating the second image data into non-afterimage data corresponding to the first image and afterimage data corresponding to the second image using a pre-trained deep neural network, a compensator outputting a compensation signal to control a luminance value of the afterimage data, and a converter converting the non-afterimage data to the first converted image data and converting the afterimage data to the second converted image data based on the compensation signal.

The deep neural network performs a semantic segmentation on the second image data in the unit of frame to separate the second image data into the non-afterimage data and the afterimage data. The deep neural network may include a fully convolutional neural network. The detector detects the non-afterimage data based on the pattern. In some examples, the detector detects the afterimage data based on the area data and the modulated data.

Embodiments of the inventive concept provide a method of preventing an afterimage including outputting area data using area information including a first area and a second area adjacent to the first area to decrease a detection sensitivity of the first area and to increase a detection sensitivity of the second area, converting RGB data of a first image data to HSV data and converting at least one of brightness data and saturation data of the HSV data to output modulated data, converting the first image data to output a second image data including the area data and the modulated data, and receiving the second image data and converting the second image data to output first converted image data obtained by converting a first image recognized as a non-afterimage component and second converted image data obtained by converting a second image recognized as an afterimage component.

The method further include forming a pattern in an area of an image corresponding to data recognized as the non-afterimage component of the modulated data after the outputting of the modulated data.

According to the above, the preprocessor converts the first image data and outputs the second image data in which the data corresponding to the second image recognized as the afterimage component is emphasized. The controller receives the second image data, predicts the first image and the second image, and separates the second image data into the non-afterimage data corresponding to the first image and the afterimage data corresponding to the second image. The controller increases detection performance with respect to the non-afterimage component and the afterimage component using the second image data and prevents the occurrence of false detection. Accordingly, the afterimage prevention method and the display device with increased display characteristics and reliability may be provided.

BRIEF DESCRIPTION OF THE DRAWINGS

The present disclosure will become readily apparent by reference to the following detailed description when considered in conjunction with the accompanying drawings wherein.

DETAILED DESCRIPTION

Figure 1:
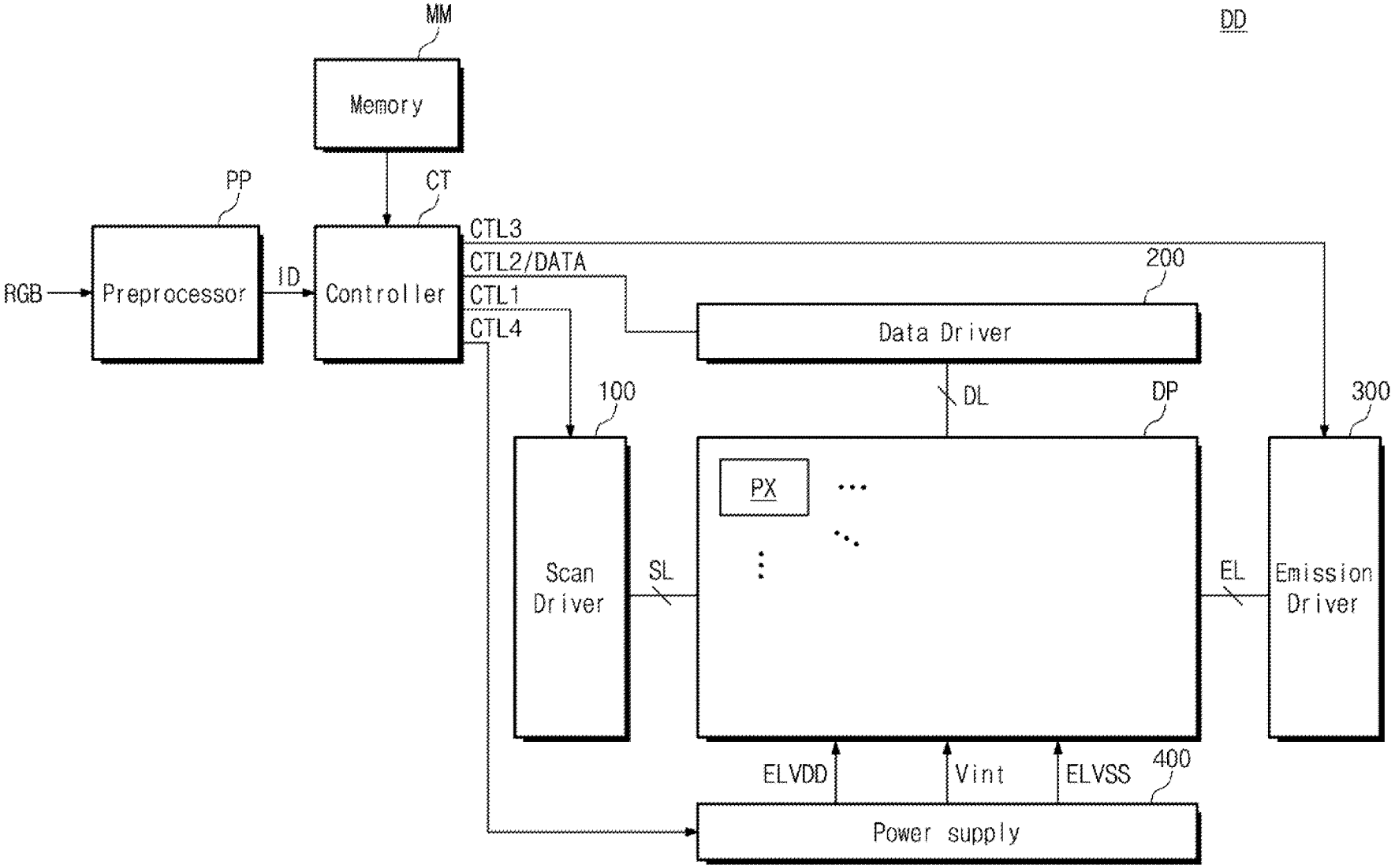
FIG. 1 is a block diagram showing a display device according to an exemplary embodiment of the present disclosure.

The present disclosure relates to an improved display device. The display device includes a preprocessor, a controller, and a display panel. The preprocessor includes an area determiner outputting area data, a modulator outputting modulated data, and a synthesizer converting first image data and outputting second image data including the area data and the modulated data.

Embodiments of the present disclosure provide for the preprocessor receiving first image data and converting the first image data to output second image data. A controller then receives the second image data and converts the second image data to output first converted image data. The first converted image data is obtained by converting a first image recognized as a non-afterimage component and second converted image data obtained by converting a second image recognized as an afterimage component. A display panel displays an image corresponding to the first converted image data and the second converted image data.

Additional embodiments of the present disclosure provide for the preprocessor converting the first image data and outputting the second image data in such a way that the data corresponding to the second image, recognized as the afterimage component, is emphasized. The controller receives the second image data, predicts the first image and the second image and separates the second image data into the non-afterimage data corresponding to the first image and the afterimage data corresponding to the second image. The controller improves detection performance with respect to the non-afterimage component and the afterimage component using the second image data, preventing the occurrence of false detection. Accordingly, an afterimage prevention method and a display device with improved display characteristics and reliability may be provided.

In the present disclosure, it will be understood that when an element or layer is referred to as being "on", "connected to" or "coupled to" another element or layer, the element or layer can be directly on, connected or coupled to the other element or layer or intervening elements or layers may be present.

Like numerals refer to like elements throughout the disclosure. In the drawings, the thickness, ratio, and dimension of components may be exaggerated for an effective description of the technical content. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Therefore, a first element, component, region, layer or section discussed below could be termed a second element, component, region, layer or section without departing from the teachings of the present disclosure. As used herein, the singular forms, "a", "an" and "the" are intended to include the plural forms as well, unless the context clearly indicates otherwise.

Spatially relative terms, such as "beneath", "below", "lower", "above", "upper" and the like, may be used herein for ease of description to describe one element or feature's relationship to another element(s) or feature(s) as illustrated in the figures.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted with a meaning consistent with the term's meaning in the context of the relevant art and will not be interpreted in an idealized or overly formal sense unless expressly so defined herein.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the present disclosure will be explained in detail with reference to the accompanying drawings.

Figure 2:
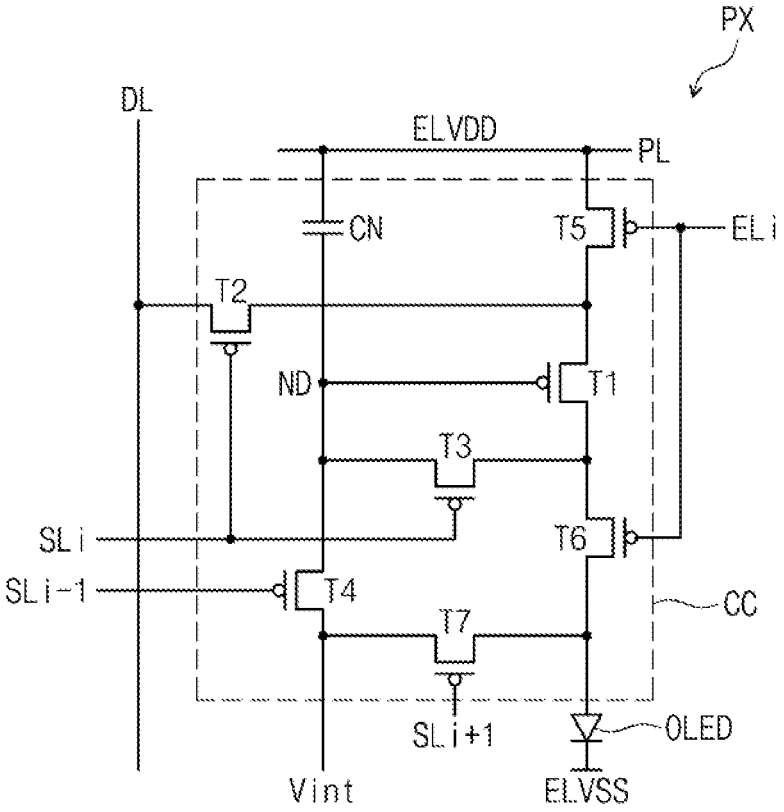
FIG. 2 is an equivalent circuit diagram showing one pixel among pixels according to an exemplary embodiment of the present disclosure.

FIG. 1 is a block diagram showing a display device DD according to an exemplary embodiment of the present disclosure, and FIG. 2 is an equivalent circuit diagram showing one pixel PX among pixels according to an exemplary embodiment of the present disclosure.

Referring to FIGS. 1 and 2, the display device DD may include a display panel DP, a preprocessor PP, a controller CT, a scan driver 100, a data driver 200, an emission driver 300, a power supply 400, and a memory MM.

The display panel DP, according to the exemplary embodiment of the present disclosure, may be a light-emitting type display panel. However, the display panel DP should not be particularly limited. For instance, the display panel DP may be an organic light-emitting display panel or a quantum dot light-emitting display panel. For example, a light-emitting layer of the organic light-emitting display panel may include an organic light-emitting material. A light-emitting layer of the quantum dot light-emitting display panel may include at least one of a quantum dot and a quantum rod. Hereinafter, the organic light-emitting display panel will be described as the display panel DP.

The display panel DP may include a plurality of data lines DL, a plurality of scan lines SL, a plurality of emission control lines EL, and a plurality of pixels PX.

The data lines DL may cross the scan lines SL. The scan lines SL may be arranged substantially parallel to the emission control lines EL. The data lines DL, the scan lines SL, and the emission control lines EL may define a plurality of pixel areas. The pixels PX displaying an image may be arranged in the pixel areas. The data lines DL, the scan lines SL, and the emission control lines EL may be insulated from each other.

Each of the pixels PX may be connected to at least one data line, at least one scan line, and at least one emission control line. The pixel PX may include a plurality of sub-pixels. Each of the sub-pixels may display one of primary colors or one of mixed colors. The primary colors may include red, green, or blue. The mixed colors may include white, yellow, cyan, or magenta. However, this is merely exemplary, and the colors displayed by the sub-pixels according to the exemplary embodiment of the present disclosure should not be limited thereto or thereby.

The preprocessor PP, the controller CT, the scan driver 100, the data driver 200, and the emission driver 300 may be electrically connected to the display panel DP in a chip-on-flexible printed circuit (COF) manner, a chip-on-glass (COG) manner, or a flexible printed circuit (FPC) manner.

The preprocessor PP may receive first image data RGB from the outside. The preprocessor PP may convert the first image data RGB to second image data ID and may output the second image data ID.

The controller CT may receive the second image data ID from the preprocessor PP. The controller CT may output first, second, third, and fourth driving control signals CTL1, CTL2, CTL3, and CTL4 and converted image data DATA. The first driving control signal CTL1 may be a signal to control the scan driver 100. The second driving control signal CTL2 may be a signal to control the data driver 200. The third driving control signal CTL3 may be a signal to control the emission driver 300. The fourth driving control signal CTL4 may be a signal to control the power supply 400. The controller CT may output the converted image data DATA obtained by converting the second image data ID.

The scan driver 100 may provide scan signals to the pixels PX through the scan lines SL in response to the first driving control signal CTL1. The image may be displayed through the display panel DP based on the scan signals.

The data driver 200 may provide data voltages to the pixels PX through the data lines DL in response to the second driving control signal CTL2. The data driver 200 may convert the converted image data DATA to the data voltages. The images displayed through the display panel DP may be determined based on the data voltages.

The emission driver 300 may provide emission control signals to the pixels PX through the emission control lines EL in response to the third driving control signal CTL3. Luminance of the display panel DP may be controlled based on the emission control signals.

The power supply 400 may provide a first power voltage ELVDD, a second power voltage ELVSS, and an initialization voltage Vint to the display panel DP in response to the fourth driving control signal CTL4. The display panel DP may be driven by the first power voltage ELVDD and the second power voltage ELVSS.

Each of the pixels PX may include a light-emitting element OLED and a pixel circuit CC. The pixel circuit CC may include a plurality of transistors T1 to T7 and a capacitor CN. The pixel circuit CC may control an amount of current flowing through the light-emitting element OLED in response to the data voltage.

The light-emitting element OLED may emit light at a predetermined luminance in response to the amount of current provided from the pixel circuit CC. The first power voltage ELVDD may have a level set higher than a level of the second power voltage ELVSS.

Each of the transistors T1 to T7 may include an input electrode (or a source electrode), an output electrode (or a drain electrode), and a control electrode (or a scan electrode). In the present disclosure, for the convenience of explanation, one electrode of the input electrode and the output electrode is referred to as a "first electrode", and the other electrode of the input electrode and the output electrode is referred to as a "second electrode".

A first electrode of a first transistor T1 may be connected to a power pattern VDD via a fifth transistor T5. A second electrode of the first transistor T1 may be connected to an anode electrode of the light-emitting element OLED via a sixth transistor T6. The first transistor T1 may be referred to as a "driving transistor".

A second transistor T2 may be connected between the data line DL and the first electrode of the first transistor T1. A control electrode of the second transistor T2 may be connected to an i-th scan line SLi. When an i-th scan signal is provided to the i-th scan line SLi, the second transistor T2 may be turned on. Therefore, the data line DL may be electrically connected to the first electrode of the first transistor T1.

A third transistor T3 may be connected between the second electrode of the first transistor T1 and a control electrode of the first transistor T1. A control electrode of the third transistor T3 may be connected to the i-th scan line SLi. When the i-th scan signal is provided to the i-th scan line SLi, the third transistor T3 may be turned on. Therefore, the second electrode of the first transistor T1 may be electrically connected to the control electrode of the first transistor T1. When the third transistor T3 is turned on, the first transistor T1 may be connected in a diode configuration.

A fourth transistor T4 may be connected between a node ND and an initialization voltage generator of the power supply 400. A control electrode of the fourth transistor T4 may be connected to an (i−1)th scan line SLi−1. When an (i−1)th scan signal is provided to the (i−1)th scan line SLi−1, the fourth transistor T4 may be turned on. Therefore, the initialization voltage Vint may be provided to the node ND.

The fifth transistor T5 may be connected between a power line PL and the first electrode of the first transistor T1. A control electrode of the fifth transistor T5 may be connected to an i-th emission control line ELi.

A sixth transistor T6 may be connected between the second electrode of the first transistor T1 and the anode electrode of the light-emitting element OLED. A control electrode of the sixth transistor T6 may be connected to the i-th emission control line ELi.

A seventh transistor T7 may be connected between the initialization voltage generator and the anode electrode of the light-emitting element OLED. A control electrode of the seventh transistor T7 may be connected to an (i+1)th scan line SLi+1. When an (i+1)th scan signal is provided to the (i+1)th scan line SLi+1, the seventh transistor T7 may be turned on. Therefore, the initialization voltage Vint may be provided to the anode electrode of the light-emitting element OLED.

The seventh transistor T7 may increase a black expression ability of the pixel PX. When the seventh transistor T7 is turned on, a parasitic capacitance (not shown) of the light-emitting element OLED may be discharged. When a black luminance is implemented, the light-emitting element OLED does not emit light due to a leakage of current from the first transistor T1. Therefore, the black expression ability may be increased.

According to embodiments of the present disclosure, an afterimages may be reduced or prevented by detecting an afterimage occurrence and location and changing the light levels of the detected area. Different areas of the display might have a different probability of being affected by an afterimage, so these areas can be identified and pre-processed to improve the performance of a neural network that identifies when an afterimage is likely to occur.

In FIG. 2, the control electrode of the seventh transistor T7 is connected to the (i+1)th scan line SLi+1. However, the present disclosure should not be limited thereto or thereby. For example, the control electrode of the seventh transistor T7 may be connected to the i-th scan line SLi or the (i−1)th scan line SLi−1.

In FIG. 2, the pixel circuit CC is implemented by PMOS transistors. However, the pixel circuit CC should not be limited thereto or thereby. For example, the pixel circuit CC may be implemented by NMOS transistors. According to another exemplary embodiment of the present disclosure, the pixel circuit CC may be implemented by a combination of NMOS transistors and PMOS transistors.

The capacitor CN may be disposed between the power line PL and the node ND. The capacitor CN may be charged with the data voltage. The amount of the current flowing through the first transistor T1 may be determined when the fifth transistor T5 and the sixth transistor T6 are turned on by the voltage charged in the capacitor CN. In the present disclosure, the equivalent circuit of the pixel PX should not be limited to the equivalent circuit shown in FIG. 2. According to another exemplary embodiment of the present disclosure, the pixel PX may be implemented in various ways that allow the light-emitting element OLED to emit the light.

The memory MM may store information about voltage values of signals sent and received between components CT, DP, 100, 200, 300, and 400 of the display device DD. The memory MM may be provided separately or may be included in at least one component of the components CT, DP, 100, 200, 300, and 400.

Figure 3:
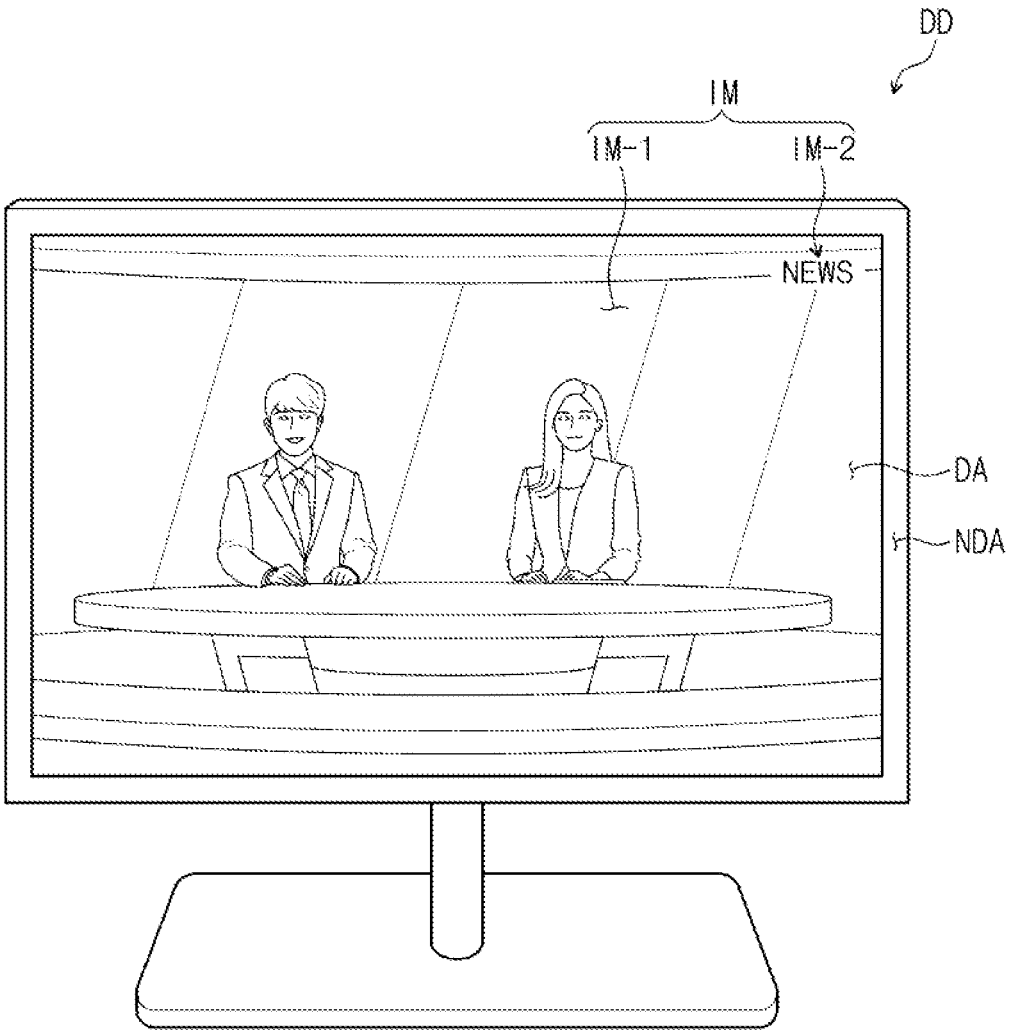
FIG. 3 is a front view showing a display device through which an image including an afterimage component is displayed according to an exemplary embodiment of the present disclosure.

FIG. 3 is a front view showing a display device through which an image including an afterimage component is displayed according to an exemplary embodiment of the present disclosure.

Referring to FIG. 3, the display device DD may include a display area DA and a non-display area NDA. The display area DA may provide an image IM to be displayed. The non-display area NDA may be disposed around the display area DA. The pixels PX (refer to FIG. 1) may be arranged in the display area DA. The image IM may include a first image IM-1 and a second image IM-2. The first image IM-1 may be recognized as a non-afterimage component. The second image IM-2 may be recognized as the afterimage component. The afterimage component may be an object which has a higher probability of an afterimage occurrence due to deterioration of the light-emitting element OLED (refer to FIG. 2) included in the display device DD than a probability of the afterimage occurrence of the non-afterimage component.

FIG. 3 shows a news screen as an example of the image IM. In the news screen, a certain word or image, such as a logo of a broadcasting company, may be continuously displayed as the second image IM-2 in the upper left or upper right portion, but the disclosure is not limited thereto or thereby. The displayed word or image may be present anywhere on the screen. FIG. 3 shows a word "NEWS" displayed on the upper right portion as a representative example.

Figure 4:
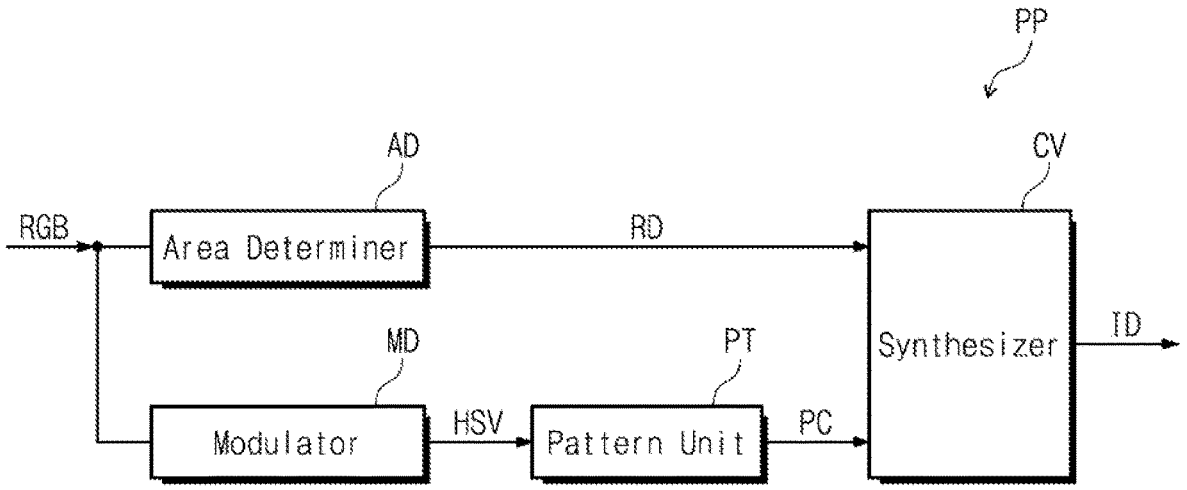
FIG. 4 is a block diagram showing a preprocessor according to an exemplary embodiment of the present disclosure.
Figure 5:
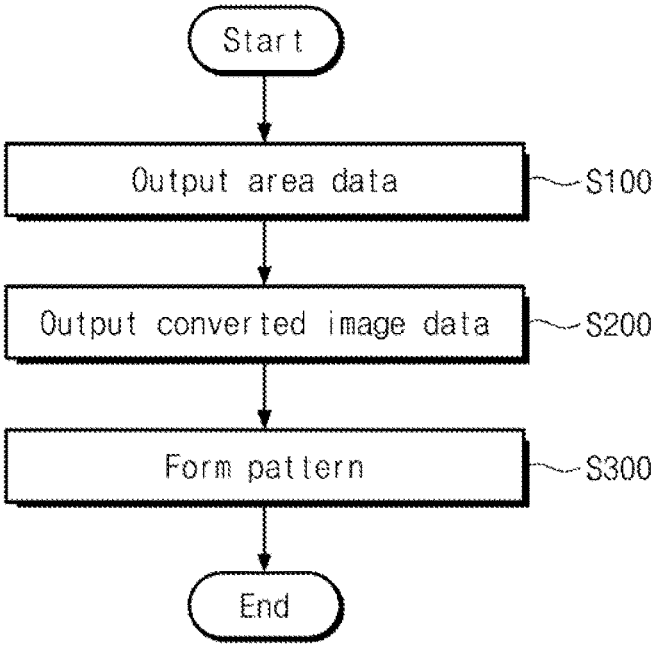
FIG. 5 is a flowchart showing a preprocessing method according to an exemplary embodiment of the present disclosure.

FIG. 4 is a block diagram showing the preprocessor PP according to an exemplary embodiment of the present disclosure, and FIG. 5 is a flowchart showing a preprocessing method according to an exemplary embodiment of the present disclosure.

Referring to FIGS. 3 to 5, the preprocessor PP may receive the first image data RGB, may convert the first image data RGB to the second image data ID, and may output the second image data ID.

The preprocessor PP may include an area determiner AD, a modulator MD, a pattern unit PT, and a synthesizer CV.

The area determiner AD may output area data RD using area information including a first area and a second area adjacent to the first area to decrease a detection sensitivity of the first area and to increase a detection sensitivity of the second area (S100).

The modulator MD may convert RGB data of the first image data RGB to HSV data. The RGB data may include red data, green data, and blue data. The HSV data may include hue data, saturation data, and brightness data. The modulator MD may modulate the brightness data and the saturation data to output modulated data HSV (S200).

The pattern unit PT may provide a pattern PC to an area of image corresponding to a predetermined data range included in the modulated data HSV (S300).

The synthesizer CV may convert the first image data RGB and may also output the area data RD, the modulated data HSV, and the second image data ID including the pattern PC.

According to embodiments of the present disclosure, the preprocessor PP may convert the first image data RGB and may output the second image data ID in which data corresponding to the second image IM-2 recognized as the afterimage component are emphasized. For example, the second image data may indicate a region including the afterimage component.

The controller CT (refer to FIG. 1) may receive the second image data ID, may predict the first image IM-1 and the second image IM-2, and may separate the second image data ID into non-afterimage data corresponding to the first image IM-1 and afterimage data corresponding to the second image IM-2. The controller CT may increase detection performance with respect to differentiating the non-afterimage component and the afterimage component through the second image data ID and may prevent the occurrence of false detection. Accordingly, the afterimage prevention method and the display device DD (refer to FIG. 1) with increased display characteristics and reliability may be provided.

Figure 6A:
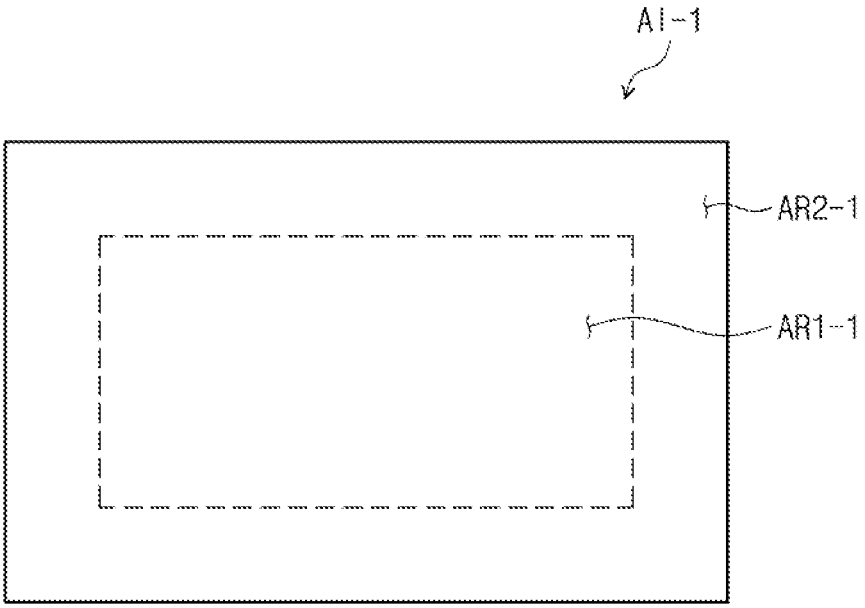
FIGS. 6A and 6B are views showing area information according to an exemplary embodiment of the present disclosure.
Figure 6B:
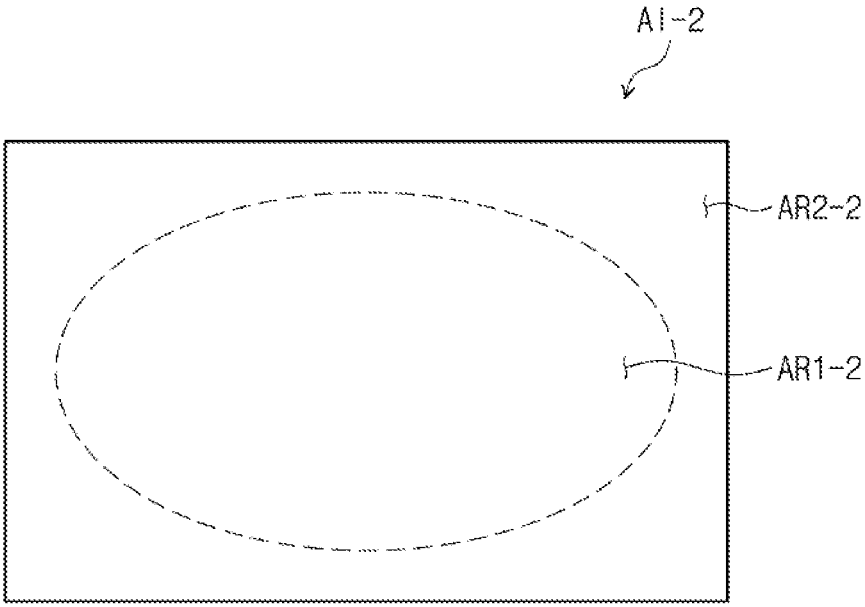

FIGS. 6A and 6B are views showing area information according to an exemplary embodiment of the present disclosure.

Referring to FIGS. 3, 6A, and 6B, the area information of the area determiner AD (refer to FIG. 4) may include one of first area information AI-1 and second area information AI-2. The first area information AI-1 may include a first area AR1-1 and a second area AR2-1 adjacent to the first area AR1-1. The first area AR1-1 may be a center area of the image IM. The second area AR2-1 may be a border area of the image IM, which surrounds the center area.

The second area information AI-2 may include a first area AR1-2 and a second area AR2-2 adjacent to the first area AR1-2. A probability that the non-afterimage component exists in the first area AR1-2 may be greater than a probability that the afterimage component exists in the first area AR1-2.

The first areas AR1-1 and AR1-2 of the first area information AI-1 and the second area information AI-2 may correspond to the area in which the first image IM-1 is displayed. The second areas AR2-1 and AR2-2 of the first area information AI-1 and the second area information AI-2 may correspond to the area in which the second image IM-2 is displayed. For example, the second image IM-2 may include a logo, a banner, a caption, and a clock. The logo may be disposed in an area defined at a right upper portion of the area information. The banner and the caption may be disposed in an area defined at a lower end portion of the area information. The clock may be disposed in an area defined in at least one of the corners of the area information.

However, the first area information AI-1 and the second area information AI-2 are merely exemplary, and the area information according to the exemplary embodiment of the present disclosure should not be limited thereto or thereby. For example, the area information may be divided into nine areas, and each area may be output as the area data RD (refer to FIG. 4) with different detection sensitivity by the area determiner AD (refer to FIG. 4).

According to the present disclosure, the area determiner AD may output the area data RD using at least one of the first area information AI-1 and the second area information AI-2. The area determiner AD may output the area data to decrease the detection sensitivity of the first areas AR1-1 and AR1-2 and to increase the detection sensitivity of the second areas AR2-1 and AR2-2. The area data RD may increase the detection performance of the controller CT with respect to the first image IM-1 and the second image IM-2 and may prevent the occurrence of false detection. Accordingly, the afterimage prevention method and the display device DD (refer to FIG. 1) with increased display characteristics and reliability may be provided.

Figure 7:
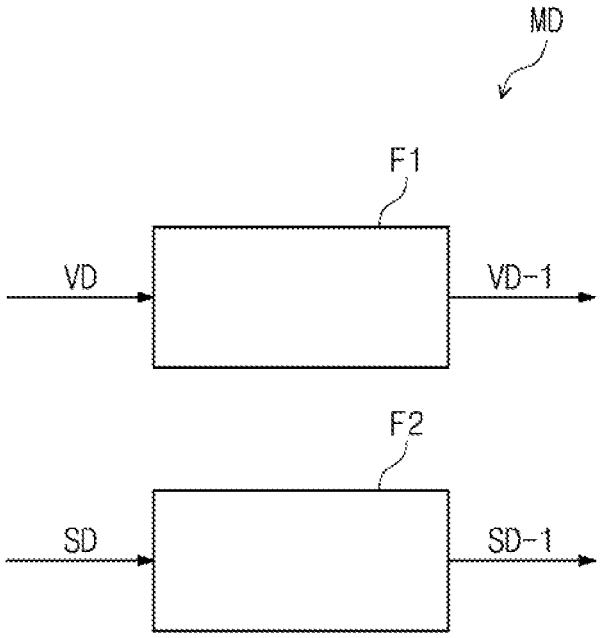
FIG. 7 is a view showing a first function and a second function according to an exemplary embodiment of the present disclosure.

FIG. 7 is a view showing a first function F1 and a second function F2, according to an exemplary embodiment of the present disclosure.

Referring to FIGS. 4 and 7, the modulator MD may include the first function F1 and a second function F2. The modulator MD may convert the RGB data of the first image data RGB to the HSV data. The first image data RGB converted to the HSV data may include the brightness data VD and the saturation data SD. The brightness data VD may be input to the first function F1 and may be output as modulated brightness data VD-1. The saturation data SD may be input to the second function F2 and may be output as modulated saturation data SD-1. The modulated data HSV output from the modulator MD may include the modulated brightness data VD-1 and the modulated saturation data SD-1.

Figure 8A:
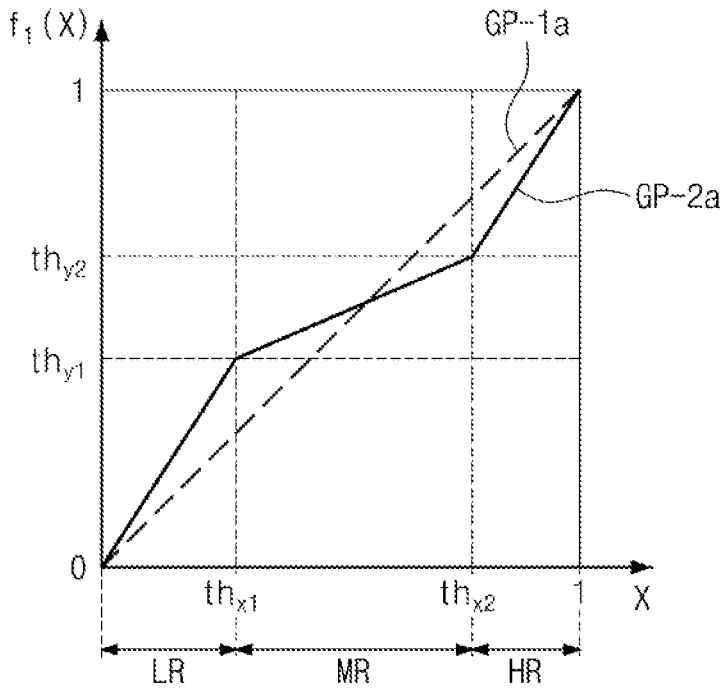
FIGS. 8A to 8C are graphs of an equations included in the first function and the second function according to an exemplary embodiment of the present disclosure.

FIG. 8A is a graph of an equation included in the first function and the second function according to an exemplary embodiment of the present disclosure.

Referring to FIGS. 3, 7, and 8A, the brightness data VD may include a first brightness input value and a second brightness input value greater than the first brightness input value. The modulated brightness data VD-1 may include a first brightness output value obtained by inputting the first brightness input value to the first function F1 and a second brightness output value obtained by inputting the second brightness input value to the first function F1. The first brightness output value may be greater than the first brightness input value. Additionally or alternatively, the second brightness output value may be smaller than the second brightness input value.

The saturation data SD may include a first saturation input value and a second saturation input value greater than the first saturation input value. The modulated saturation data SD-1 may include a first saturation output value obtained by inputting the first saturation input value to the second function F2 and a second saturation output value obtained by inputting the second saturation input value to the second function F2. The first saturation output value may be greater than the first saturation input value, and the second saturation output value may be smaller than the second saturation input value.

A first input value $th_{x1}$ may be the first brightness input value or the first saturation input value. A second input value $th_{x2}$ may be the second brightness input value or the second saturation input value. A first output value $th_{y1}$ may be the first brightness output value or the first saturation output value. A second output value $th_{y2}$ may be the second brightness output value or the second saturation output value.

At least one of the first function F1 and the second function F2 may include the following equation.

$$f_1(x) = \begin{cases} a_1 x, & x < th_{x1} \\ 1 - a_2(1 - x), & x \geq th_{x2} \\ th_{y1} + a_3(x - th_{x1}), & \text{otherwise} \end{cases} \quad \text{Equation 1}$$

In Equation 1, "x" denotes the brightness data VD or the saturation data SD, "$f_1(x)$" denotes the modulated brightness data VD-1 or the modulated saturation data SD-1, "$th_{x1}$" denotes the first input value, "$th_{y1}$" denotes the first output value, "$th_{x2}$" denotes the second input value, "$th_{y2}$" denotes the second output value, "$a_1$" denotes "$th_y/th_{x1}$", "$a_2$" denotes "$(1-th_{y2})/(1-th_{x2})$", and "$a_3$" denotes "$(th_{y2}-th_{y1})/(th_{x2}-th_{x1})$".

A first graph GP-1*a* may represent the brightness data VD or the saturation data SD. A second graph GP-2*a* may represent the modulated brightness data VD-1 or the modulated saturation data SD-1. The second graph GP-2*a* may satisfy Equation 1.

Each of the brightness data VD or the saturation data SD may include a first area LR, a second area MR, and a third area HR. The first area LR may be an area including data between zero (0) and the first input value $th_{x1}$ in the brightness data VD or the saturation data SD. The second area MR may be an area including data between the first input value $th_{x1}$ and the second input value $th_{x2}$ in the brightness data VD or the saturation data SD. The third area HR may be an area including data between the second input value $th_{x2}$ and one (1) in the brightness data VD or the saturation data SD.

The data included in the first area LR may be data recognized as a low luminance or a low saturation in the image IM. The modulated brightness data VD-1 and/or the modulated saturation data SD-1 corresponding to the data included in the first area LR may be determined with Equation 1.

The data included in the second area MR may be data recognized as an intermediate luminance or an intermediate saturation in the image IM. The modulated brightness data VD-1 or the modulated saturation data SD-1 corresponding to the data included in the second area MR may be compressed by Equation 1.

The data included in the third area HR may be data recognized as a high luminance or a high saturation in the image IM. The modulated brightness data VD-1 or the modulated saturation data SD-1 corresponding to the data included in the third area HR may be indicated according to Equation 1.

According to the present disclosure, the first image IM-1 recognized as the non-afterimage component may be recognized as one of the intermediate luminance and the intermediate saturation. The second image IM-2 recognized as the afterimage component may be recognized as one of the high luminance, the low luminance, the high saturation, and the low saturation. The first function F1 and the second function F2 may compress the data corresponding to the first image IM-1 and may emphasize the data corresponding to the second image IM-2. The modulated data HSV may increase the detection performance of the controller CT with respect to the first image IM-1 and the second image IM-2 and may prevent the occurrence of false detection. Accordingly, the afterimage prevention method and the display device DD (refer to FIG. 1) with increased display characteristics and reliability may be provided.

Figure 8B:
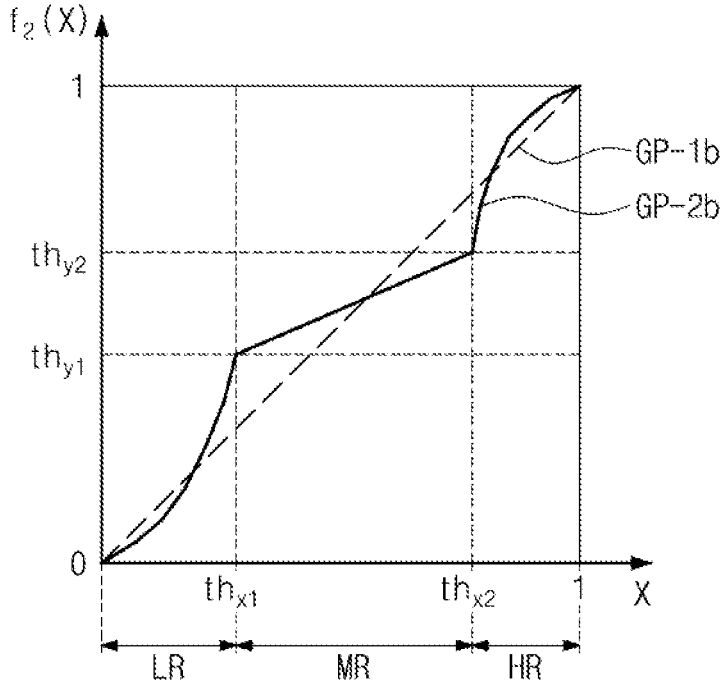

FIG. 8B is a graph of an equation included in the first function and the second function according to an exemplary embodiment of the present disclosure. In FIG. 8B, the same reference numerals denote the same elements in FIG. 8A. Therefore, detailed descriptions of the same elements will be omitted.

Referring to FIG. 8B, at least one of the first function F1 and the second function F2 may include the following equation.

$$f_2(x) = \begin{cases} th_{y1}(r_1x)^2, & x < th_{x1} \\ 1-(1-th_{y2})(r_2(1-x))^2, & x \geq th_{x2} \\ th_{y1} + a_3(x - th_{x1}), & \text{otherwise} \end{cases} \quad \text{Equation 2}$$

In Equation 2, "x" denotes the brightness data VD or the saturation data SD, "$f_2(x)$" denotes the modulated brightness data VD-1 or the modulated saturation data SD-1, "$th_{x1}$" denotes the first input value, "$th_{y1}$" denotes the first output value, "$th_{x2}$" denotes the second input value, "$th_{y2}$" denotes the second output value, "$r_1$" denotes "$1/th_{x1}$", "$r_2$" denotes "$1/(1-th_{x1})$", and "$a_3$" denotes "$(th_{y2}-th_{y1})/(th_{x2}-th_{x1})$".

A first graph GP-1*b* may represent the brightness data VD or the saturation data SD. A second graph GP-2*b* may represent the modulated brightness data VD-1 or the modulated saturation data SD-1. The second graph GP-2*b* may satisfy Equation 2.

Figure 8C:
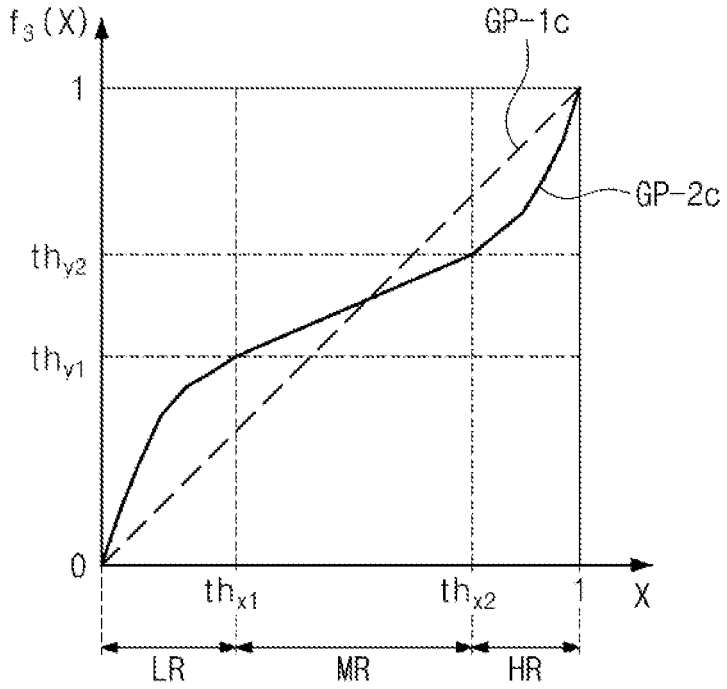
Figure 9A:
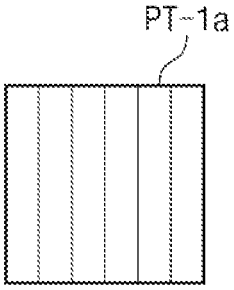
FIGS. 9A to 9D are views showing shapes of patterns provided by a pattern unit according to an exemplary embodiment of the present disclosure.
Figure 9B:
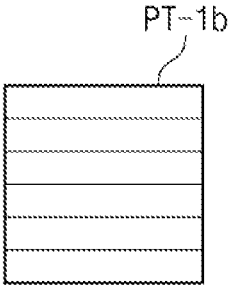
Figure 9C:
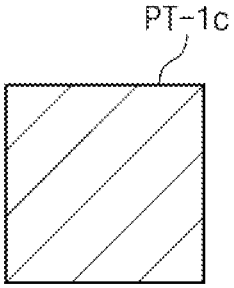
Figure 9D:
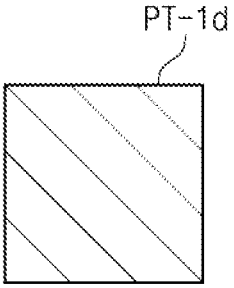

FIG. 8C is a graph of an equation included in the first function and the second function according to an exemplary embodiment of the present disclosure. In FIG. 8C, the same reference numerals denote the same elements in FIG. 8A. Therefore, detailed descriptions of the same elements will be omitted.

Referring to FIG. 8C, at least one of the first function F1 and the second function F2 may include the following equation.

$$f_3(x) \begin{cases} th_{y1}(2r_1x - (r_1x)^2), & x < th_{x1} \\ 1-(1-th_{y2})(2r_2(1-x) - (r_2(1-x))^2), & x \geq th_{x2} \\ th_{y1} + a_3(x - th_{x1}), & \text{otherwise} \end{cases} \quad \text{Equation 3}$$

In Equation 3, "x" denotes the brightness data VD or the saturation data SD, "$f_2(x)$" denotes the modulated brightness data VD-1 or the modulated saturation data SD-1, "$th_{x1}$" denotes the first input value, "$th_{y1}$" denotes the first output value, "$th_{x2}$" denotes the second input value, "$th_{y2}$" denotes the second output value, "$r_1$" denotes "$1/th_{x1}$", "$r_2$" denotes "$1/(1-th_{x1})$", and "$a_3$" denotes "$(th_{y2}-th_{y1})/(th_{x2}-th_{x1})$".

A first graph GP-1*c* may represent the brightness data VD or the saturation data SD. A second graph GP-2*c* may represent the modulated brightness data VD-1 or the modulated saturation data SD-1. The second graph GP-2*c* may satisfy Equation 3.

The descriptions about the first area LR, the second area MR, and the third area HR may be equally applicable to those of FIGS. 8B and 8C.

FIGS. 9A to 9D are views showing shapes of patterns provided by the pattern unit PT according to an exemplary embodiment of the present disclosure.

Referring to FIGS. 4, 8A, and 9A to 9D, the pattern unit PT may provide the pattern PC overlapping an area of an image corresponding to data between the first output value $th_{y1}$ and the second output value $th_{y2}$. The data between the first output value $th_{y1}$ and the second output value $th_{y2}$ may be the modulated brightness data VD-1 or the modulated saturation data SD-1 corresponding to the data included in the second area MR.

The pattern PC may have a shape extending in a first direction and spaced apart from each other in a second direction crossing the first direction. The shape of the pattern PC may correspond to one of a first pattern PT-1*a*, a second pattern PT-1*b*, a third pattern PT-1*c*, and a fourth pattern PT-1*d*. However, this is merely exemplary, and the shapes of the pattern PC according to the exemplary embodiment of the present disclosure should not be limited thereto or thereby. For example, the shape of the pattern PC may have a dot pattern.

According to the present disclosure, the data between the first output value $th_{y1}$ and the second output value $th_{y2}$ may be compressed by the first function F1 (refer to FIG. 7) and the second function F2 (refer to FIG. 7). The area overlapping the pattern PC may correspond to an area corresponding to the compressed data. The pattern PC may be provided to the controller CT (refer to FIG. 1). The controller CT (refer to FIG. 1) may increase detection performance with respect to the first image IM-1 (refer to FIG. 3) recognized as the non-afterimage component using the pattern PC and may prevent the occurrence of false detection. Accordingly, the afterimage prevention method and the display device DD (refer to FIG. 1) with increased display characteristics and reliability may be provided.

Figure 10A:
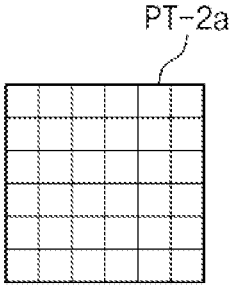
FIGS. 10A and 10B are views showing shapes of the patterns provided from the pattern unit according to an exemplary embodiment of the present disclosure.
Figure 10B:
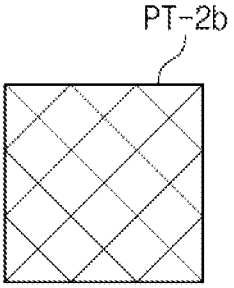

FIGS. 10A and 10B are views showing shapes of the pattern provided from the pattern unit according to an exemplary embodiment of the present disclosure.

Referring to FIGS. 4, 10A, and 10B, the pattern PC may have a shape extending in the first direction, spaced apart from each other in the second direction crossing the first direction, extending in the second direction, and spaced apart from each other in the first direction. For example, the shape of the pattern PC may include a checkered pattern. The shape of the pattern PC may correspond to one of a first pattern PT-2*a* and a second pattern PT-2*b*. However, this is merely exemplary, and the shapes of the pattern PC according to the exemplary embodiment of the present disclosure should not be limited thereto or thereby.

Figure 11:
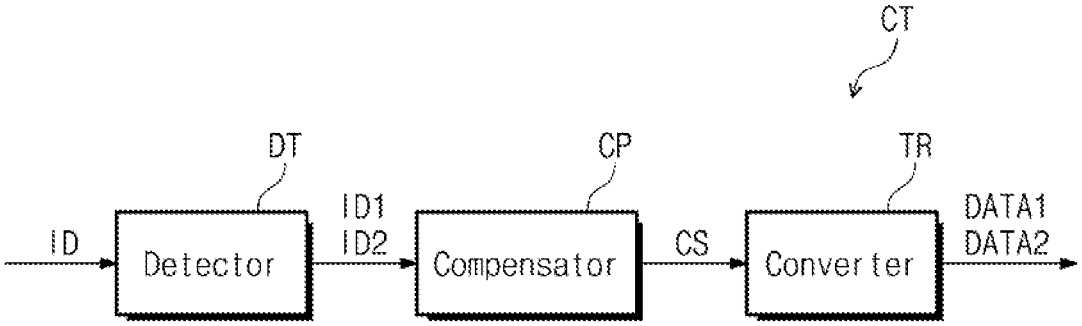
FIG. 11 is a block diagram showing a controller according to an exemplary embodiment of the present disclosure.

FIG. 11 is a block diagram showing the controller CT according to an exemplary embodiment of the present disclosure.

Referring to FIGS. 3 and 11, the controller CT may receive the second image data ID, may convert the second image data ID to the converted image data DATA (refer to FIG. 1), and may output the converted image data DATA. The converted image data DATA (refer to FIG. 1) may include first converted image data DATA1 and second converted image data DATA2.

The second image data ID may be output by the synthesizer CV (refer to FIG. 4) of the preprocessor PP (refer to FIG. 1). The second image data ID may include the area data RD (refer to FIG. 4), the modulated data HSV (refer to FIG. 4), and the pattern PC (refer to FIG. 4). However, this is merely exemplary, and the second image data ID according to the exemplary embodiment of the present disclosure should not be limited thereto or thereby. For example, the second image data ID may include at least one of the area data RD (refer to FIG. 4), the modulated data HSV (refer to FIG. 4), the hue data, and the pattern PC or may include at least one of the data obtained by converting the modulated data HSV (refer to FIG. 4) to the RGB data, the area data RD (refer to FIG. 4) and the pattern PC.

The controller CT may include a detector DT, a compensator CP, and a converter TR.

The detector DT may separate the second image data ID into non-afterimage data ID1 corresponding to the first image IM-1 and after image data ID2 corresponding to the second image IM-2 using a pre-trained deep neural network.

The detector DT may detect the non-afterimage data ID1 based on the pattern PC. The detector DT may detect the afterimage data ID2 based on the area data RD and the modulated data HSV.

The memory MM (refer to FIG. 1) may receive data used to update the deep neural network from the outside. The detector DT may receive the updated deep neural network from the memory MM (refer to FIG. 1).

The compensator CP may output a compensation signal CS to control a luminance value of the second image data ID. The converter TR may receive the image data RGB (refer to FIG. 4) and the compensation signal CS. The converter TR may convert the non-afterimage data ID1 to the first converted image data DATA1 based on the image data RGB (refer to FIG. 4) and may convert the afterimage data ID2 to the second converted image data DATA2 based on the image data RGB (refer to FIG. 4) and the compensation signal CS. The display panel DP (refer to FIG. 1) may display the image IM (refer to FIG. 3) corresponding to the first converted image data DATA1 and the second converted image data DATA2.

According to the present disclosure, the detector DT may separate the second image data ID into the non-afterimage data ID1 and the afterimage data ID2 using the deep neural network. The compensation signal CS may control a luminance of the afterimage component of the second image IM-2 corresponding to the afterimage data ID2. The image may be prevented from being damaged in an area adjacent to the afterimage component. Accordingly, the afterimage prevention method and the display device DD (refer to FIG. 1) with increased display characteristics and reliability may be provided.

Figure 12:
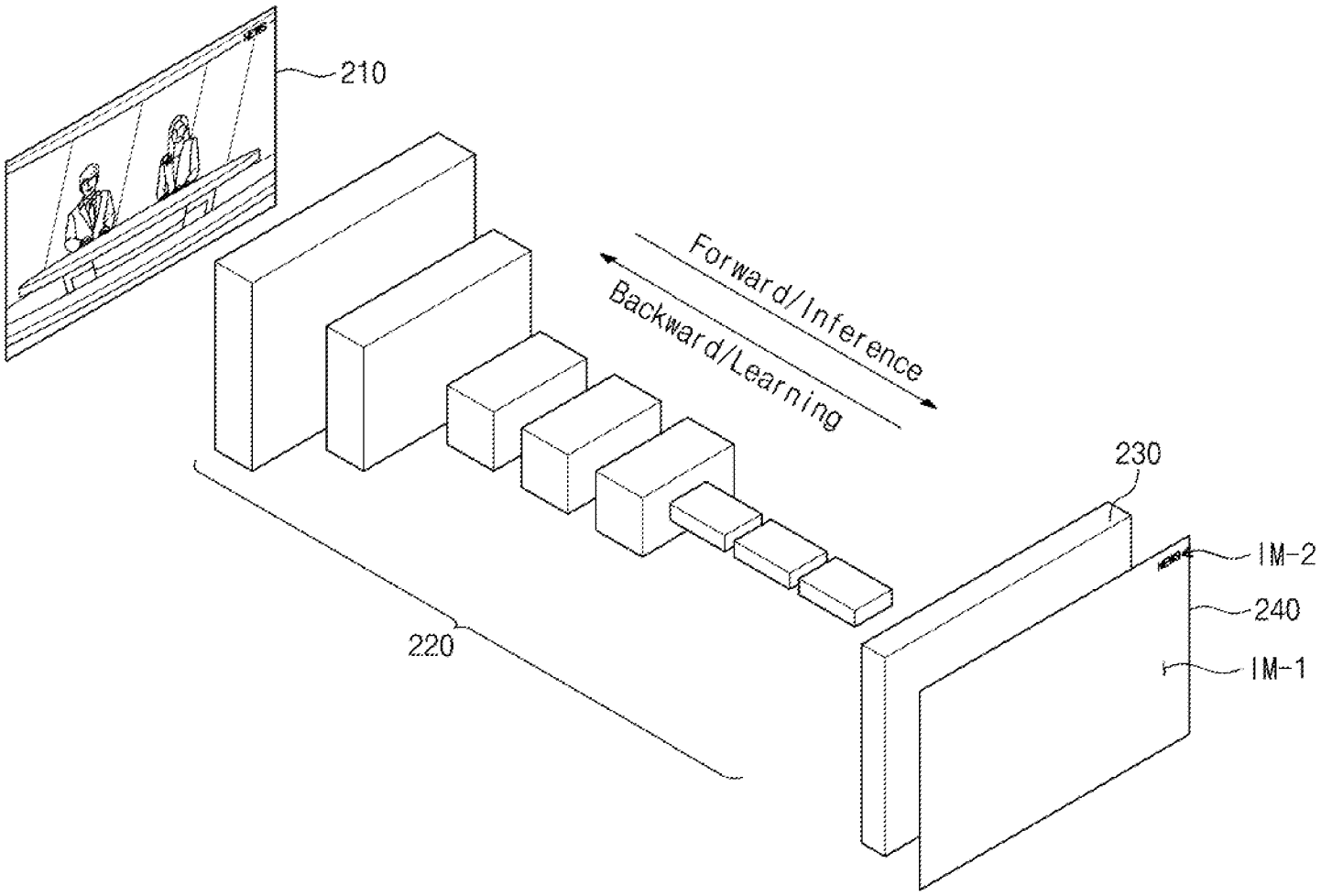
FIG. 12 is a view showing a fully convolutional neural network according to an exemplary embodiment of the present disclosure.

FIG. 12 is a view showing a fully convolutional neural network according to an exemplary embodiment of the present disclosure.

Referring to FIGS. 11 and 12, artificial intelligence refers to the field of science concerned with the study and design of intelligent machines, and machine learning refers to the field of science defining and solving various problems dealt with in the field of artificial intelligence. Machine learning may refer to algorithms that computer systems use to enhance the performance of a specific task, based on consistent experience on the task (e.g., using training data).

A deep neural network is one example of a model used in machine learning. In some examples, a deep neural network may be designed to simulate a human brain structure on the detector DT. Deep neural networks may include artificial neurons (i.e., nodes) that form a network connected by synaptic connections. In some cases, the term deep neural network refers to a model with problem-solving ability in general. A deep neural network may be defined by a connection pattern between neurons of different layers, a learning process that updates model parameters, and an activation function that generates an output value.

A deep neural network may include an input layer, an output layer, and at least one hidden layer. Each layer may include one or more neurons, and the deep neural network may include synapses (i.e., connections) that link neurons to neurons. In a deep neural network, each neuron may output function values of activation functions for signals, weights, and deflections, which are input through the synapses.

In some cases, a deep neural network may be trained according to a supervised learning algorithm. For example, a supervised learning algorithm may be used to find a fixed answer through an algorithm. Accordingly, a deep neural network based on a supervised learning algorithm may infer the function from training data. In a supervised learning algorithm, a labeled sample may be used for the training. The labeled sample may refer to a particular output value that should be inferred by the deep neural network when learning data are input to the deep neural network.

The algorithm may receive a series of learning data and may predict a particular output value corresponding to the learning data. During training, prediction errors may be identified by comparing an actual output value and the particular output value with respect to input data, and the algorithm or network parameters may be modified based on the result.

The output value of a supervised learning algorithm may include semantic segmentation. Semantic segmentation may refer to the technique of classifying each pixel in an image into an object class. Semantic segmentation may refer to the technique of distinguishing objects constituting an input image 210 in the unit of pixel within the input image 210 corresponding to the image data RGB input to the algorithm. For example, objects included in each of the first image IM-1 recognized as the non-afterimage component and the second image IM-2 recognized as the afterimage component may be distinguished from each other in the unit of pixel in labeled data 240. As an example, the second image IM-2 may correspond to the word "NEWS" displayed in the certain word in the image IM (refer to FIG. 3).

Accordingly, a deep neural network may perform semantic segmentation on the second image data ID in the unit of frame to separate the second image data ID into the non-afterimage data ID1 corresponding to the first image IM-1 and the afterimage data ID2 corresponding to the second image IM-2.

The deep neural network may include a fully convolutional neural network (FCN), a convolutional neural network (CNN), a recurrent neural network (RNN), a deep belief network (DMN), or a restricted Boltzman machine (RBM). However, this is merely exemplary, and the deep neural network should not be limited thereto or thereby. Hereinafter, an exemplary deep neural network will be described as including a fully convolutional neural network.

FIG. 12 shows the input image 210, the fully convolutional neural network 220, an activation map 230 output from the fully convolutional neural network 220, and the labeled data 240.

Convolutional layers of the fully convolutional neural network 220 may be used to extract features, such as borders, lines, colors, etc., from the input image 210. Each convolutional layer may receive data, may process the data input applied thereto, and may generate data output therefrom. The data output from the convolutional layer may be generated by applying the input data to one or more filters.

Initial convolutional layers of the fully convolutional neural network 220 may be operated to extract simple features with low levels from the input. Next convolutional layers may be operated to extract complex features with higher levels than those of the initial convolutional layers. The data output from each convolutional layer may be referred to as an activation map or a feature map. The fully convolutional neural network 220 may perform other processing operations in addition to applying a convolution filter to the activation map. The processing operation may include a pooling operation. However, this is merely exemplary, and the processing operation according to the exemplary embodiment of the present disclosure should not be limited thereto or thereby. For example, the processing operation may include a resampling operation.

When the input image 210 passes through several layers of the fully convolutional neural network 220, the size of the activation map may be reduced. A process of scaling-up the result of the reduced activation map by the size of the input image 210 is used to perform the estimation in the unit of pixel since the semantic segmentation involves the estimation of the object in the unit of pixel. As a method of enlarging the value obtained through a 1×1 convolution operation to the size of the input image 210, a bilinear interpolation technique, a deconvolution technique, or a skip-layer technique may be used. The size of the activation map 230 output from the fully convolutional neural network 220 may be substantially the same as the input image 210. Accordingly, the activation map 230 may maintain information about the position of the object. The process in which the fully convolutional neural network 220 receives the input image 210 and outputs the activation map 230 may be called a "forward inference".

The activation map 230 output from the fully convolutional neural network 220 may be compared with the labeled data 240 of the input image 210. Therefore, losses may be calculated. The losses may be propagated back to the convolutional layers through a back-propagation technique. Connection weights in the convolutional layers may be updated based on the losses that are propagated back. Methods of calculating the loss may include loss functions such as a hinge loss, a square loss, a softmax loss, a cross-entropy loss, an absolute loss, and an insensitive loss.

The method of learning through the back-propagation algorithm may include updating the weights of the nodes constituting the learning network according to the loss calculated by transferring a value from the output layer to the input layer in the case where the output value obtained through a process starting from input layer and ending at the output layer is a wrong answer when compared with a reference label value. In this case, a training data set provided to the fully convolutional neural network 220 may be defined as ground truth data or the labeled data 240. As the training data set according to the exemplary embodiment of the present disclosure, thousands to tens of thousands of still images may be provided. The label may indicate a class of the object. The object may correspond to the afterimage component of the second image IM-2. For example, the label may include a logo, a banner, a caption, a clock, a weather icon, or the like.

After the fully convolutional neural network 220 performs the learning process using the input image 210, a learning model with optimized parameters may be generated. When data that are not labeled are input to the learning model, the labeled data corresponding to the input data may be predicted.

According to the present disclosure, the deep neural network of the detector DT may include the fully convolutional neural network 220. The fully convolutional neural network 220 may not require a frame buffer and may segment the object corresponding to the afterimage component in the unit of frame for the image data RGB, thereby classifying the afterimage component itself in real-time. The compensator CP may control the luminance of the afterimage data ID2 corresponding to the second image IM-2, which is recognized as the afterimage. Therefore, the compensator CP may prevent the afterimage of the image IM from being generated. Accordingly, the afterimage prevention method and the display device DD (refer to FIG. 1) with increased display characteristics and reliability may be provided.

Thus, embodiments of the inventive concept include a method of preventing an afterimage by identifying a first area of an image and a second area of the image, where the first area is more likely to include an afterimage effect than the second area; predicting afterimage information for the image using a neural network based on the identified first area and second area; and applying afterimage compensation to the image based on the predicted afterimage information, wherein the afterimage compensation reduces the likelihood of the afterimage effect.

In some examples the method described above further includes generating area data based on the first area and the second area; generating modulated data based on first image data for the image, wherein the modulated data comprises brightness data obtained using a first function and saturation data obtained using a second function; generating pattern data based on the modulated data; and generating second image data based on the first image data, the area data, the modulated data, and the pattern data, wherein the afterimage information is predicted based on the second image data. In some examples the method described above further includes generating a compensation signal to control a luminance of the image, wherein the afterimage compensation is applied based on the compensation signal.

Although exemplary embodiments of the present disclosure have been described, it is understood that the present disclosure should not be limited to these exemplary embodiments but various changes and modifications can be made by one ordinary skilled in the art within the spirit and scope of the present disclosure as hereinafter claimed. Therefore, the disclosed subject matter should not be limited to any single embodiment described herein, and the scope of the present inventive concept shall be determined according to the attached claims.

What is claimed is:

1. A display device comprising:

a preprocessor configured to receive a first image data and to convert the first image data to output a second image data;

a controller configured to receive the second image data and to convert the second image data to output first converted image data obtained by converting a first image recognized as a non-afterimage component and to output second converted image data obtained by converting a second image recognized as an afterimage component, and a display panel configured to display an image corresponding to the first converted image data and the second converted image data, the preprocessor comprising:

an area determiner configured to output area data using area information comprising a first area and a second area adjacent to the first area to decrease a detection sensitivity of the first area and to increase a detection sensitivity of the second area;

a modulator configured to convert RGB data of the first image data to HSV data and to modulate brightness data and saturation data of the HSV data to output modulated data; and a synthesizer configured to convert the first image data to output the second image data comprising the area data and the modulated data, wherein the controller includes a detector configured to separate the second image data into non-afterimage data corresponding to the first image and afterimage data corresponding to the second image using a pre-trained deep neural network based on the area data from the area determiner, wherein the modulated data comprise modulated brightness data obtained by inputting the brightness data to a first function and modulated saturation data obtained by inputting the saturation data to a second function, wherein the brightness data comprise a first brightness input value and a second brightness input value greater than the first brightness input value, and the modulated brightness data comprise a first brightness output value obtained by inputting the first brightness input value to the first function and a second brightness output value obtained by inputting the second brightness input value to the first function, and wherein the first brightness output value is greater than the first brightness input value, and the second brightness output value is smaller than the second brightness input value, wherein the saturation data comprise a first saturation input value and a second saturation input value greater than the first saturation input value, and the modulated saturation data comprise a first saturation output value obtained by inputting the first saturation input value to the second function and a second saturation output value obtained by inputting the second saturation input value to the second function, and wherein the first saturation output value is greater than the first saturation input value, and the second saturation output value is smaller than the second saturation input value, and wherein at least one of the first function and the second function comprises $$f_1(x) = \begin{cases} a_1 x, & x < th_{x1} \\ 1 - a_2(1-x), & x \geq th_{x2} \\ th_{y1} + a_3(x - th_{x1}), & \text{otherwise} \end{cases}$$

where "x" denotes the brightness data or the saturation data, "$f_1(x)$" denotes the modulated brightness data or the modulated saturation data, "$th_{x1}$" denotes the first brightness input value or the first saturation input value, "$th_{y1}$" denotes the first brightness output value or the first saturation output value, "$th_{x2}$" denotes the second brightness input value or the second saturation input value, "$th_{y2}$" denotes the second brightness output value or the second saturation output value, "$a_1$" denotes "$th_{y1}/th_{x1}$", "$a_2$" denotes "$(1-th_{y2})/(1-th_{x2})$", and "$a_3$" denotes "$(th_{y2}-th_{y1})/(th_{x2}-th_{x1})$".

2. The display device of claim 1, wherein the first area is a center area of the image, and the second area is a border area of the image, which surrounds the center area.

3. The display device of claim 1, wherein a probability that the non-afterimage component exists in the first area is greater than a probability that the afterimage component exists in the first area, and a probability that the afterimage component exists in the second area is greater than a probability that the non-afterimage component exists in the second area.

4. The display device of claim 1, wherein at least one of the first function and the second function further comprises $$f_2(x) = \begin{cases} th_{y1}(r_1 x)^2, & x < th_{x1} \\ 1 - (1 - th_{y2})(r_2(1-x))^2, & x \geq th_{x2} \\ th_{y1} + a_3(x - th_{x1}), & \text{otherwise} \end{cases}$$

where "x" denotes the brightness data or the saturation data, "$f_2(x)$" denotes the modulated brightness data or the modulated saturation data, "$th_{x1}$" denotes the first brightness input value or the first saturation input value, "$th_{y1}$" denotes the first brightness output value or the first saturation output value, "$th_{x2}$" denotes the second brightness input value or the second saturation input value, "$th_{y2}$" denotes the second brightness output value or the second saturation output value, "$r_1$" denotes "$1/th_{x1}$", "$r_2$" denotes "$1/(1-th_{x1})$", and "$a_3$" denotes "$(th_{y2}-th_{y1})/(th_{x2}-th_{x1})$".

5. The display device of claim 1, wherein at least one of the first function and the second function further comprises $$f_3(x) \begin{cases} th_{y1}(2r_1 x - (r_1 x)^2), & x < th_{x1} \\ 1 - (1 - th_{y2})(2r_2(1-x) - (r_2(1-x))^2), & x \geq th_{x2} \\ th_{y1} + a_3(x - th_{x1}), & \text{otherwise} \end{cases}$$

where "x" denotes the brightness data or the saturation data, "$f_3(x)$" denotes the modulated brightness data or the modulated saturation data, "$th_{x1}$" denotes the first brightness input value or the first saturation input value, "$th_{y1}$" denotes the first brightness output value or the first saturation output value, "$th_{x2}$" denotes the second brightness input value or the second saturation input value, "$thy_2$" denotes the second brightness output value or the second saturation output value, "$r_1$" denotes "$1/th_{x1}$", "$r_2$" denotes "$1/(1-th_{x1})$", and "$a_3$" denotes "$(th_{y2}-th_{y1})/(th_{x2}-th_{x1})$".

6. The display device of claim 1, wherein the preprocessor further comprises a pattern unit configured to provide a pattern to an area of an image corresponding to the modulated brightness data between the first brightness output value and the second brightness output value and an area of an image corresponding to the modulated saturation data between the first saturation output value and the second saturation output value.

7. The display device of claim 6, wherein the pattern has a shape extending in a first direction and spaced apart from each other in a second direction crossing the first direction.

8. The display device of claim 6, wherein the pattern has a shape extending in a first direction, spaced apart from each other in a second direction crossing the first direction, extending in the second direction, and spaced apart from each other in the first direction.

9. The display device of claim 6, wherein the second image data further comprise the pattern.

10. The display device of claim 9, wherein the controller further comprises:

a compensator configured to output a compensation signal to control a luminance value of the afterimage data; and a converter configured to convert the non-afterimage data to the first converted image data and to convert the afterimage data to the second converted image data based on the compensation signal.

11. The display device of claim 10, wherein the deep neural network is configured to perform a semantic segmentation on the second image data in a unit of frame to separate the second image data into the non-afterimage data and the afterimage data.

12. The display device of claim 11, wherein the deep neural network comprises a fully convolutional neural network.

13. The display device of claim 10, wherein the detector is configured to detect the non-afterimage data based at least in part on the pattern.

14. The display device of claim 10, wherein the detector is configured to detect the afterimage data based on the area data and the modulated data.

15. A method of preventing an afterimage, comprising:

outputting area data using area information comprising a first area and a second area adjacent to the first area to decrease a detection sensitivity of the first area and to increase a detection sensitivity of the second area;

converting RGB data of a first image data to HSV data and converting at least one of brightness data and saturation data of the HSV data to output modulated data;

converting the first image data to output a second image data comprising the area data and the modulated data;

separating the second image data into non-afterimage data corresponding to the first image and afterimage data corresponding to the second image using a pre-trained deep neural network based on the area data;

receiving the second image data and converting the second image data to output first converted image data obtained by converting a first image recognized as a non-afterimage component and second converted image data obtained by converting a second image recognized as an afterimage component, wherein the modulated data comprise modulated brightness data obtained by inputting the brightness data to a first function and modulated saturation data obtained by inputting the saturation data to a second function, wherein the brightness data comprise a first brightness input value and a second brightness input value greater than the first brightness input value, and the modulated brightness data comprise a first brightness output value obtained by inputting the first brightness input value to the first function and a second brightness output value obtained by inputting the second brightness input value to the first function, and wherein the first brightness output value is greater than the first brightness input value, and the second brightness output value is smaller than the second brightness input value, wherein the saturation data comprise a first saturation input value and a second saturation input value greater than the first saturation input value, and the modulated saturation data comprise a first saturation output value obtained by inputting the first saturation input value to the second function and a second saturation output value obtained by inputting the second saturation input value to the second function, and wherein the first saturation output value is greater than the first saturation input value, and the second saturation output value is smaller than the second saturation input value, and wherein at least one of the first function and the second function comprises $$f_1(x) = \begin{cases} a_1 x, & x < th_{x1} \\ 1 - a_2(1 - x), & x \geq th_{x2} \\ th_{y1} + a_3(x - th_{x1}), & \text{otherwise} \end{cases}$$

where "x" denotes the brightness data or the saturation data, "$f_1(x)$" denotes the modulated brightness data or the modulated saturation data, "$th_{x1}$" denotes the first brightness input value or the first saturation input value, "$th_{y1}$" denotes the first brightness output value or the first saturation output value, "$th_{x2}$" denotes the second brightness input value or the second saturation input value, "$th_{y2}$" denotes the second brightness output value or the second saturation output value, "$a_1$" denotes "$th_{y1}/th_{x1}$", "$a_2$" denotes "$(1-th_{y2})/(1-th_{x2})$", and "$a_3$" denotes "$(th_{y2}-th_{y1})/(th_{x2}-th_{x1})$".

16. The method of claim 15, further comprising forming a pattern in an area of an image corresponding to data recognized as the non-afterimage component of the modulated data after the outputting of the modulated data.

* * * * *